United States Patent [19]

Beskow et al.

[11] Patent Number: 4,755,082

[45] Date of Patent: Jul. 5, 1988

[54] REMOVABLE BOTTOM FOUNDED STRUCTURE

[75] Inventors: Robert H. Beskow, Midland, Tex.; Patrick J. Dunn, Pleasant Hill; Warren S. Fine, Kenwood, both of Calif.

[73] Assignee: Chevron Research Company, San Francisco, Calif.

[21] Appl. No.: 45,028

[22] Filed: May 1, 1987

Related U.S. Application Data

[63] Continuation-in-part of Ser. No. 898,989, Mar. 3, 1986, Pat. No. 4,695,201.

[30] Foreign Application Priority Data

Feb. 3, 1987 [CA] Canada ..... 530903

[51] Int. Cl.[4] ..... E02B 17/02

[52] U.S. Cl. ..... 405/217; 405/195; 405/203; 405/224; 114/296

[58] Field of Search ..... 405/195, 203, 204, 205, 405/224, 217, 208; 114/296

[56] References Cited

U.S. PATENT DOCUMENTS

| | | | |
|---|---|---|---|
| 3,348,517 | 10/1967 | Johnson et al. | 114/296 |
| 4,314,776 | 2/1982 | Palmer et al. | 405/205 |
| 4,425,055 | 1/1984 | Tiedemann | 405/217 |
| 4,522,532 | 6/1985 | Fedrick | 405/195 X |
| 4,576,518 | 3/1986 | Cooke et al. | 405/195 X |
| 4,695,201 | 9/1987 | Beskon et al. | 405/195 X |

*Primary Examiner*—Dennis L. Taylor

*Attorney, Agent, or Firm*—S. R. LaPaglia; Edward J. Keeling; V. A. Norviel

[57] ABSTRACT

The Removable Bottom Founded Structure (RBFS) is an offshore platform for petroleum drilling and producing operations intended for deployment in waters with severe weather and iceberg conditions. It is a two-part structure comprising (1) a platform which is made up of a deck structure, multiple columns and braces; and (2) a reinforced concrete subbase that rests on the sea floor and upon which the platform is founded. The structure is normally held down by gravity for standard platform operations, but during the deballasting procedure due to an iceberg emergency a hold-down system is employed to keep the platform on the subbase until full deballasting is achieved. The system that is used to hold the platform down onto the subbase is located where the platform meets the subbase. It operates on the principle of hydrostatics. On the underside of the columns there are multiple chambers which may be evacuated by pumping and which are vented to the outside atmosphere. Flexible seals that define these chambers are positively inflated by water to create a fluid-tight seal so that no seawater will enter the evacuated chambers. The reduction of the buoyancy forces will hold the platform onto the subbase until such time as the platform is totally deballasted. Once that has occurred, the hydrostatic hold-down system is disengaged and the platform will quickly rise to the surface to assume its floating draft and avoid the iceberg danger. An effective load transfer system between the platform and the subbase is also disclosed.

6 Claims, 7 Drawing Sheets

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

REMOVABLE BOTTOM FOUNDED STRUCTURE

CROSS REFERENCE TO RELATED APPLICATIONS

This application is a continuation-in-part of application Ser. No. 898,989, filed Mar. 3, 1986, now U.S. Pat. No. 4,695,201.

This application is related to applications having the Ser. Nos. 835,419; 835,420; 866,825; 839,492; 869,525; and 869,529, all assigned to the assignee of this application.

FIELD OF THE INVENTION

This invention generally relates to offshore oil drilling and producing structures. More specifically, to a structure that may be removably detached from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these conditions, many different types of platform designs have arisen in an attempt to cope with the harsh weather and other natural elements.

Currently, much exploration is conducted in the arctic and in the ice-infested waters off Alaska, Canada, and Greenland. To cope with the iceberg and weather problem, some structures attempt to resist these large ice masses by simply being large enough to withstand the largest conceivable impact forces. Examples of these designs may be seen in dual cone structures, such as U.S. Pat. No. 4,245,929, large reef-like structures, or many other gravity based large concrete-steel configurations, see also U.S. Pat. No. 4,504,172. However, these structures are either very heavy, very expensive, or are permanently affixed to the sea bottom. As such, they do not lend themselves to either reuse or quick site evacuation in the case of an emergency situation. In addition, ultimate removal and abandonment of these structures upon oil field depletion is extremely difficult. Due to the wide variability in iceberg characteristics and lack of data about them, a more problematic issue with these structures concerns the definition of the largest iceberg to design for—the selection of the design iceberg requires a reasonable balance of risks and costs, made difficult by the inherent uncertainties.

Another factor to be considered is cost. Generally, the type of large gravity based structure that may be used for arctic exploration and production is very expensive and time consuming to build. With the unproven nature of some of the oil prospects, the harshness of the environment, the increased costs and delays due to the weather down time, the probability of failure, and even the political climate, it becomes even more risky for an oil company to invest a large amount of money or time. In the event of an accident or other type of misadventure, losses could be greatly multiplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy or ballast and a subbase upon which the platform may rest. The complete structure may then be towed in a floating mode to an offshore drilling/production site and slowly filled with ballast until both the platform and the subbase rest on the sea floor in a gravity-based mode. When a situation, threatening to the structure, presents itself, the platform may be deballasted back to a floating condition and removed from the site to leave the subbase behind. However, this deballasting procedure is quite slow (on the order of 6 to 7 hours) and since it is probably going to be done in rough seas, there is a large chance that the platform, and/or the subbase on which it rests, may be damaged when it "bounces around" due to wave action as it approaches neutral buoyancy on the subbase and then while it slowly ascends to its final floating draft.

A solution to this problem is to keep the platform on the subbase with a temporary hold-down means while it is being deballasted. Once it has fully deballasted, the hold-down means may then be released to allow the platform to quickly ascend to its floating draft and escape damage.

This hold-down system may be mechanical or hydraulic, however, because a mechanical system: may not assure a simultaneous release of all connection units; is expensive; requires a sophisticated control system; and is difficult to reuse or to replace damaged or used connection units, a hydrostatic sealing system is chosen. This hydrostatic system will hold the platform to the subbase from the beginning of the deballasting procedure to the time when deballasting is complete. After deballasting, the platform may be quickly detached by releasing the hold-down system and then floated away from the impending iceberg danger.

The hold-down system is one of two components of the platform interface system. The second component is the load transfer system. The load transfer system comprises hydraulic capsules mounted on a convex frame which provides a continuous load path for gravity and environmental loads during all phases of operation.

To eliminate most of the problems of these previously mentioned arctic structures for use in iceberg-infested waters, the Removable Bottom Founded Structure (RBFS) concept was developed to provide a platform which may be removably detached on short notice from its subbase and, if necessary, transported to a safer location. Other advantages of this structure include providing: (1) a wellhead protection device (i.e., the subbase) against those icebergs large enough to scour the sea floor, (2) a capacity for a higher deck load than floating structures (as the RBFS rests on the sea bottom in the normal operating mode), (3) the ability to quickly evacuate the platform from its fixed location on the sea floor by deballasting and then releasing the hold-down means, (4) reduced capital costs from the gravity based structures due to a more economical design, (5) greater flexibility in structure siting due to the platform's mobility, (6) direct subsea well access from the fixed deck overhead, (7) protection of the vertical production risers from waves and ice due to their placement within the platform columns, and (8) the ability to relocate most of the structure to a new site if dictated by changing reservoir information (only a new subbase would be required for each relocation).

SUMMARY OF THE INVENTION

The present invention holds a buoyant platform onto a subbase that rests permanently under its own weight on the sea floor. The structure is called a Removable Bottom Founded Structure (RBFS) and it is designed for the arctic environment. The RBFS resembles a very large submersible drilling platform which, by virtue of its direct overhead access to the subsea wells, functions in many ways like a conventional fixed drilling and production platform. Normally the platform would be fully ballasted on the subbase with water ballast. However, in the event of an approaching iceberg (larger than one which the RBFS is designed to resist), the hold-down sealing system is engaged, the platform is deballasted to a positive buoyancy condition, the risers are disconnected from the subbase, then the hold-down sealing system is released, and the platform floats and propels itself off location to leave the subbase behind.

The platform must be disconnected from the subbase to reach its floating draft very quickly so that there is no collision between the platform and subbase during platform liftoff due to wave action. To do this, the hold-down system is engaged to hold the platform down on the subbase, the platform columns and pontoons are deballasted to achieve a large net buoyant upward force, and then the hold-down mechanism is quickly released. The above operations, up to release of the hold-down system, are always controllable by the platform's operators. If a threatening iceberg subsequently leaves the area before the point of actual liftoff, the operations can easily be reversed.

To provide an appropriate hold-down mechanism, an inflatable seal and a passive elastomeric seal are affixed on the underside of a column to seal a space off from the outside environment (although only four of the RBFS' six columns would be configured for sealing). Once this space is established, the hydrostatic head in the space may be reduced to keep the platform on location until such time when it is fully deballasted. The platform stays in place during this time by effectively removing the buoyancy forces from the underside of the columns; thus, the platform's own weight alone holds the platform down as if it were not resting submerged in water.

A means for transferring environmental loads from the platform to the subbase is also described. The load transfer system serves as a continuous load path mechanism.

The load transfer system is described in which a vertical member of the offshore structure has a concave base plate; and in which a convex raised section on the subbase generally adapted to fit into the concave base plate; and in which a convex frame is generally adopted to fit between the convex raised section and the concave base plate, and in which there are hydraulic capsules mounted on the convex frame, the capsules adopted to be inflated such that a load on the capsules can be adjusted. In a preferred embodiment, the capsules are flatjacks and are spaced along a perimeter of said frame. There is also a means for adjusting the load in the capsules with hydraulic fluid and means for subsequently filling the capsules with grout. The concave base plate further comprises a horizontal doughnut shaped bearing plate and an inclined truncated cone shaped bearing plate. The convex frame is a tubular steel frame on which the hydraulic capsules are mounted. The tubular shell frame is adapted to fit in recesses in the convex raised section, the recesses adopted to receive the frame. Resilient bumpers are mounted to the concave base plate.

DETAILED DESCRIPTION OF THE INVENTION

The Removable Bottom Founded Structure (RBFS) is an offshore structure for petroleum drilling and producing operations and is intended for deployment in waters with severe weather and iceberg conditions. The RBFS is a two-part structure. The first part generally comprises a platform and is made up of multiple columns which are affixed at substantially 90° to the deck structure. Cross bracing and other horizontal members are also used to make the platform more stable. The second component is a reinforced concrete subbase that rests on the sea floor and upon which the platform is founded.

The RBFS is designed to withstand severe conditions of wind, wave and current action, and many of those ice conditions which could normally be expected during the structure's life. For example, the RBFS is designed to withstand a 150-year return period storm; an iceberg with a 20-year return period kinetic energy; and to survive (with some damage) an impact with an iceberg having a 100-year return period kinetic energy. However, if an iceberg large enough to cause damage to the RBFS threatens to come in contact with the structure, the platform is evacuated from the site to leave the subbase behind. To ensure that the inhabitants and operators of the RBFS are apprized of all iceberg and storm dangers, they maintain visual lookouts for clear days and shorter distances, whereas they use a platform-based radar system for longer distances and less clear weather (they may also rely on ships and aircraft). Danger zones, having specified radii from the platform, may also be established to allow the platform personnel to gauge the possibility of actual iceberg incursion and take appropriate action. The towing of some icebergs by various boats supporting the platform is also possible, although the variability and number of potential icebergs prevent a complete reliance on iceberg towing.

Figure 1:
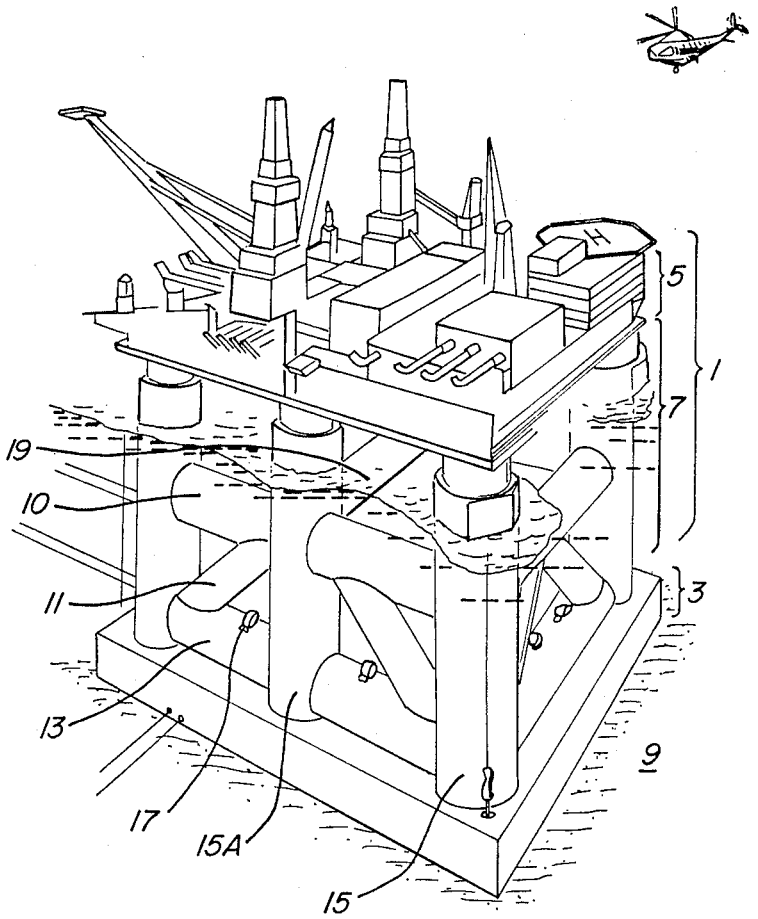
FIG. 1 is a view of the assembled platform resting on the subbase.

Referring now to the drawings, FIG. 1 discloses that the RBFS comprises two portions, a platform 1, which is further divided into a hull 7 and a deck 5, and a subbase 3. The hull 7 is the frame assembly that extends from the upper side of the subbase 3 to the underside of the deck 5. It has six columns, four corner columns 15 and two central columns 15*a*, each are 20 m in diameter and configured in a two by three arrangement. The corner columns are spaced at center line dimensions of 83 m×116 m. The four corner columns can be sealed, while the two center columns enclose the production risers. Six upper horizontal braces 10 extend between the columns 15 and 15*a* around the hull perimeter at a center line elevation of 47 m above the bottom of the hull 7. A seventh horizontal brace 19 connects the central columns 15*a* at the same elevation. Each of the seven upper horizontal braces are 13 m in diameter. Six horizontal pontoon braces 13 of 12.5 m in diameter extend between the columns 15 and 15*a* around the hull perimeter at a center line elevation of 6.8 m. The hull 7 has ten 10 m diameter diagonal braces 11 in both the transverse and longitudinal directions. Two diagonal braces 11 are located on each face of the hull perimeter between the upper horizontal braces 10 and the pontoon braces 13, while the remaining two connect the seventh horizontal brace 19 with the central columns 15*a*.

The outer shell of the members of the hull 7 which are directly exposed to iceberg impacts consists of a hybrid steel-concrete-steel sandwich. These members include the six columns 15 and 15*a*, the six perimeter upper horizontal braces 10, and the eight perimeter diagonal braces 11. The sandwich design provides strength to withstand the high local pressures associated with iceberg impacts. The steel sections are welded by standard shipyard construction techniques and extensive use of automatic welding. The infill concrete would be high-strength, lightweight concrete and would be placed between the steel sections using standard techniques and equipment adapted to this application.

Figure 2:
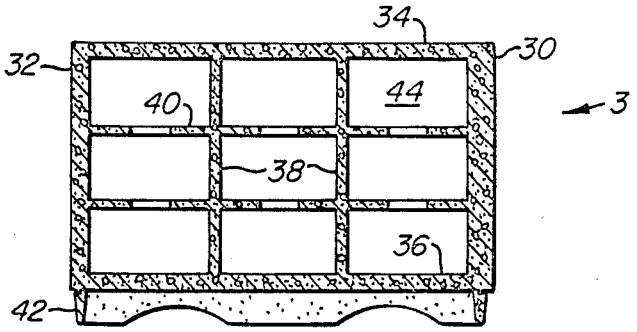
FIG. 2 is a cross-sectional view of a portion of the subbase.
Figure 3:
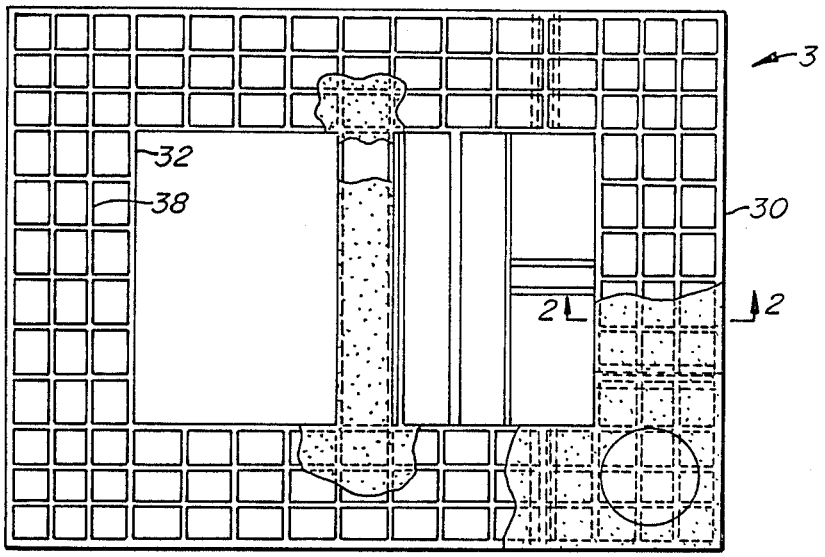
FIG. 3 is a partially cut-away and overhead plan view of the subbase (the footprint of one of the six platform columns is shown on the overhead view)

The subbase 3 is a permanent reinforced concrete structure, the configuration of which is shown in FIGS. 2 and 3. When the platform 1 is not present, it is designed to withstand a 100-year iceberg impact with practically no movement and no structural damage and to survive a 2000-year iceberg (while protecting a subsea well template located inside it), with limited damage and movement. The subbase 3 provides a bearing surface for vertical and lateral load transfer from the platform 1 during normal operations and it first anchors the platform and later protects the template from iceberg scour during iceberg emergency operations. In one embodiment, the subbase 3 is a cellular structure resembling a rectangular doughnut in plan view with out-to-out dimensions of approximately 370.6×480.9 ft. It is 50 ft high with 7 ft deep skirts 42 extending from the underside of the subbase into the soil. The typical subbase cross-section is 85 ft wide by 49 ft high, with four slabs and four walls in the longitudinal direction (perpendicular to the cross-section) and with transverse walls spaced along its length. Solid and liquid ballast are placed in the compartments provided by the cellular design. The principle components of the subbase 3 include outboard 30 and inboard walls 32, top 34 and bottom slabs 36, and interior walls 38 and slabs 40. The outboard wall 30 extends around the outer perimeter of the subbase 3, and the inboard wall 32 forms the inner perimeter. The top 34 and bottom slabs 36 form the roof and the floor of the subbase 3, respectively.

Interior walls 38 and slabs 40 are used to partition the subbase 3 into compartments 44, a typical cross section is three compartments high and three wide as shown in FIG. 2. These interior walls 38 and slabs 40 divide the subbase 3 into solid ballast compartments 44 (filled via a surface controlled system during initial RBFS installation) and greatly increase the shear capacity of the cross section. Fourteen water ballast compartments in the subbase 3, required for subbase tow and installation, are each composed of 27 solid ballast compartments 44 (3×3 compartments 44 in plan view over the full height of the subbase). Those interior walls 38 between water ballast compartments, as well as top 34 and bottom slabs 36 and outboard 30 and inboard walls 32, are all designed for watertightness. Furthermore, concrete skirt sections 42 extend from the underside of the subbase into the soil and help transfer lateral forces into the soil and, with a sand undergrouting system, accommodate uneven seabed conditions. The skirt pattern in plan view is the same as the pattern of all watertight walls.

There are at least two ways to install the platform 1 onto the subbase 3. In one method for initial installation of the RBFS (which could also be used to resite the platform 1), the subbase 3 as the foundation is affixed alone to the sea floor 9 by many of the means used for the installation of gravity based structures, such as: tow to the offshore site; hookup of the floating subbase 3 to a pre-installed onsite mooring system (a spring buoy and clumpweight system, which is not illustrated); lowering and placement on the sea floor 9 by controlled flooding of water ballast compartments to a slightly positive buoyancy condition and thereafter by mooring system tension adjustments; leveling and penetration of the skirts 42 into the soil by continued controlled flooding and by solid ballast placement inside the compartments 44; and sand undergrouting between the skirts 42, the bottom slab 36, and the sea floor 9. All of the above operations are controlled at the surface from various ships. The subbase 3 is permanently founded by virtue of its own structural weight, the weight of the solid ballast placed inside the compartments 44, the undergrouting and the skirt penetration into the soil. In the rough seas normally encountered at exposed offshore arctic sites, the subbase installation operations may be quite difficult, particularly the lowering and placement.

Once the subbase 3 is installed, the clumpweight mooring system is removed and replaced with a standard chain-and-buoy mooring system. The platform 1 is floated over the subbase 3, hooked up to the mooring system and positioned. A tendon relocation system is then employed. Four tendons 6, similar to those on tension leg platforms (TLPs), are lowered from the platform 1, stabbed into receptacles on the subbase 3, and tensioned with a jacking system on the deck 5. While maintaining a constant tension and controlling lateral movements by mooring system adjustments, the platform 1 is lowered to just above the subbase 3 by selective admission of seawater ballast into the interior of the hull members. Employing a pin-and-cone docking system for final lateral alignment, continued water ballasting allows the platform 1 to land on the subbase 3. Further water ballast is added to weight the platform 1 down on the subbase 3 in a gravity-based mode.

The only requirement is that the platform 1 be properly weighted down on the subbase 3 with a water ballast quantity large enough to provide sufficient resistance to all possible platform movements (e.g., rocking or sliding) due to wave action. At this point, the platform 1 is stable and connection of the production risers may begin as well as drilling operations. The above platform installation operation will be used to relocate the platform 1 after its evacuation for an iceberg emergency, as well as for the first method here of initial RBFS installation.

However, the second preferred method for initial RBFS installation is to join the platform 1 and subbase 3 in a floating mating operation prior to their transportation to the final offshore site. The floating subbase 3 is towed to a sheltered deepwater location near land, hooked up to a spring buoy and clumpweight mooring system already installed there, and lowered to a depth just above the sea floor 9. Lowering is accomplished by controlled compartment flooding with water ballast to a slightly buoyant condition and then by pulling the subbase 3 down, and keeping it stationary, with the mooring system. This operation is similar to that performed offshore for the first method above, although the protected waters make it less difficult and risky.

Next the platform 1 is hooked up to a separate, conventional chain-and-buoy mooring system (not illustrated) at the site, and positioned over the submerged subbase 3. The four tendons 6 discussed above are lowered from the platform 1 and stabbed into the subbase receptacles. The tendons 6 are slightly tensioned. By deballasting the subbase 3, pulling it up with the tendons 6, making adjustments with the two mooring systems and using docking devices, the subbase 3 is raised and then mated with the platform 1. The tendons 6 are fully tensioned to serve as a sea fastening, securing the subbase 3 to the platform 1 for the sea tow. Within naval architectural limits, they are also secured together by increasing the buoyancy of the subbase 3 and reducing the buoyancy of the platform 1, squeezing the two components together. The hydrostatic hold-down system then undergoes preliminary tests at the deepwater construction site. The platform 1 and subbase 3 are disconnected from their respective mooring systems, and the mooring systems are later retrieved.

The RBFS is then towed to location, hooked up to a pre-installed onsite mooring system (conventional chain-and-buoy type), ballasted down (by controlled flooding of water ballast compartments in the hull members and in the subbase 3) and positioned by mooring system adjustments, until the subbase 3 rests in its final desired position on the sea floor 9. RBFS leveling and skirt penetration, solid ballast placement in the subbase 3, and sand undergrouting proceed in much the same manner as discussed above for the first method, although these operations are considerably simplified by the presence of the platform 1. The platform 1 is weighted down with water ballast as above. These operations result in a completed bottom founded structure. The tendons 6 are retrieved, the mooring system is disconnected, and the hydrostatic hold-down system is thoroughly tested. Drilling and production operations may then commence.

There may be times when the platform 1 will have to be moved from its location due to a threatening iceberg. Before the platform 1 can abandon site, it must be deballasted to reach a desired floating draft. However, if it is deballasted and permitted to rise slowly off the subbase 3 in rough waters, there is the risk that the platform 1 may come in contact with the subbase 3. This could cause a considerable amount of damage to both the platform 1 and the subbase 3 and may even go so far as to cause the platform 1 to flood and sink. As a result, a hydrostatic hold-down system 50 keeps the platform 1 down onto the subbase 3 while it is being deballasted. The hold-down system 50 is disengaged once sufficient liquid ballast has been removed from the platform 1 so that it may rise to its floating draft, in a rapid fashion, without incurring any damage.

Instrumental to all phases of the platform's life are the platform/subbase interface components, i.e., the "load transfer and hold-down systems". These integrated systems prevent problems associated with mating major components, therefore, providing reliable load transfer between components, and allowing safe departure of the platform from the subbase during iceberg emergencies.

The functions of the integrated interface components are:

a. To provide a means of compensating for dimensional differences between the platform and subbase. Given that the platform and subbase are extremely large structures, there is a chance that the structures would mate less than perfectly, especially considering that the two structures could be built in different locations. A vertical differential tolerance up to 2 inches is expected.

b. To provide alignment guides for platform/subbase mating during initial joining of the platform and subbase at the deepwater construction site, and any platform relocation operations following iceberg emergency lift-off events.

c. To provide a continuous load path for gravity and environmental loads during all phases of operation.

d. To shorten the time required for overall time required for removal by concurrently deballasting the platform while shutting in wells, purging and disconnecting production risers, etc.

As previously stated, the platform 1 must rise quickly to its floating draft to prevent potential collision between the platform 1 and the subbase 3 during an iceberg avoidance operation. Furthermore, to shorten the time required for the overall iceberg avoidance procedure, the operators of the platform will shut in wells, and purge and disconnect the drilling and production risers, while concurrently deballasting the platform 1. The hydrostatic pressure that acts on the platform 1 is temporarily reduced by the hold-down system to hold the platform 1 onto the subbase 3 while it is being deballasted (and thus becomes more buoyant). To accomplish this, a system of hold-down seals 50 enclose the perimeter of the base of each corner column 15. After the spaces, enclosed by this system of seals 50, are separated from the outside seawater, the hold-down system is activated. This is done by reducing the hydrostatic pressure that acts on the bottom of the column, effectively holding the platform 1 on the subbase 3 by virtue of the platform's own weight.

The hydrostatic hold-down system 50 reduces the hydrostatic head on the area underneath the column 15.

Figure 4:
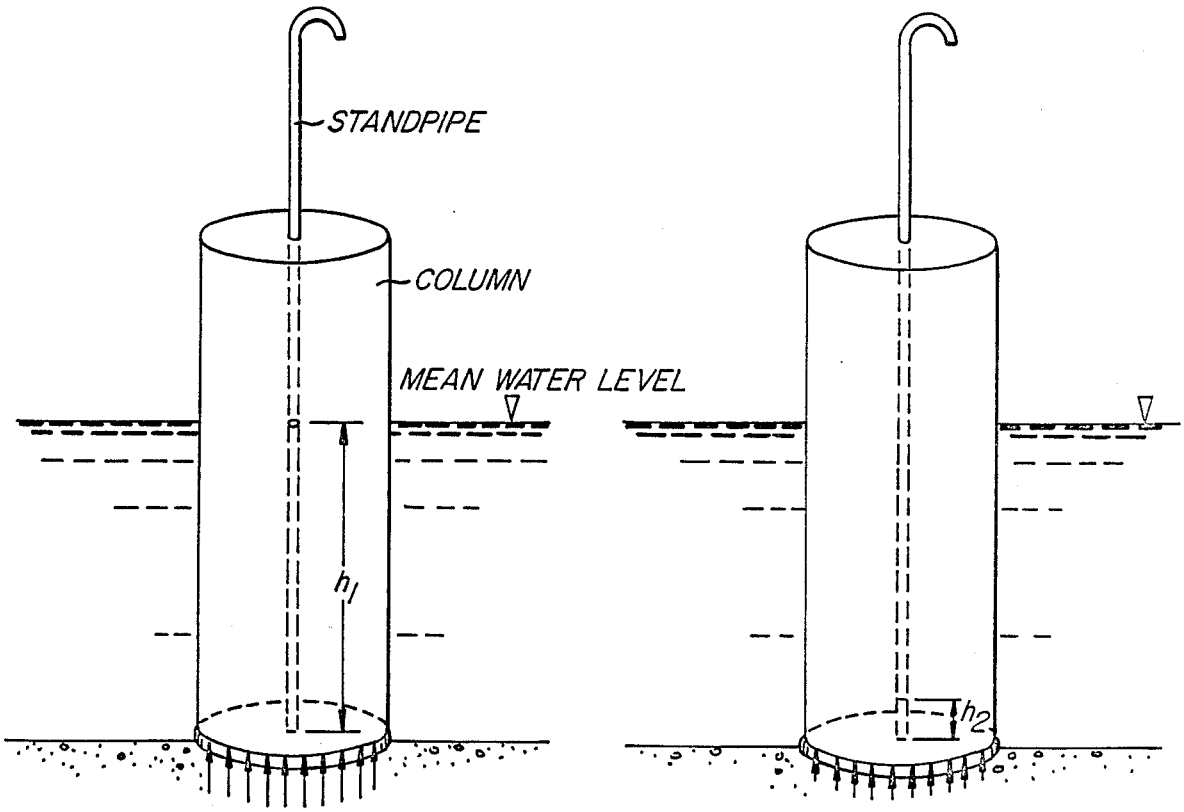
FIG. 4 is a representation of the forces that act on the underside of a buoyant column.

This is shown in FIG. 4 which represents the buoyancy forces acting on a column 15 before and after the sealing system is engaged. In normal operations, the buoyant force that acts on a column 15 may be shown by $P_l = \delta \cdot h_l$. A where $P_l$ is the total buoyant force, $\delta$ is the density of water, $h_l$ is the height of water in a standpipe (the depth below water surface in normal operations), and A is the area underneath the column 15. However, when the hold-down system is activated, the water level in the standpipe can be reduced to $h_2$ by pumping water out of the sealing spaces. This decreases the buoyant force to a new value which can be expressed as $P_2 = \delta \cdot h_2 \cdot$ A and which can equal zero as $h_2$ is lowered to zero. The difference in hydrostatic pressure between the outside environment and the space underneath the column 15 is maintained by the seals around the perimeter of the column. While the seals are engaged, the pressure difference keeps the platform 1 on location.

Figure 5:
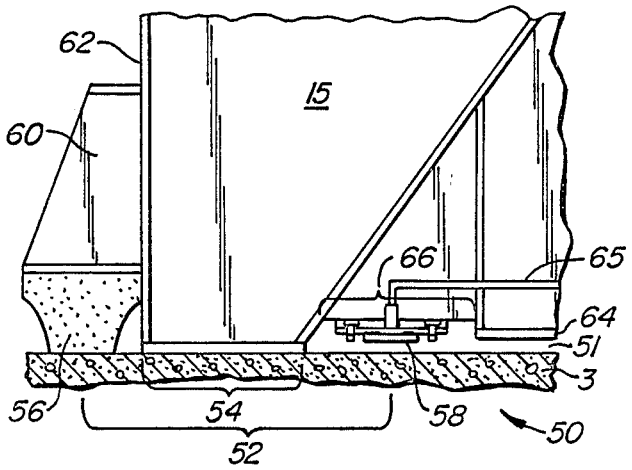
FIG. 5 is a cross-sectional view of the seal system mounted in the underside of a column.

FIG. 5 shows the entire hold-down system 50. Concentric seals 56 and 58 at the perimeter of each corner column 15 enclose hold-down chambers 51 and 52 between the column 15 and the subbase 3. During normal platform operation, when the RBFS behaves as a gravity structure and a hold-down force is not needed, the chambers 51 and 52 are open to the ambient hydrostatic pressure. In an iceberg emergency requiring platform evacuation, the platform operators would first activate the seals 58, then create a hold-down force by reducing the hydrostatic pressure in chambers 51 and 52 (by dewatering), and finally deballast the platform 1 to make it more buoyant. The hold-down force equals the product of the plan area of the chambers 51 and 52 and the differential pressure in the chambers 51 and 52 which is $\Delta P = \delta(h_l - h_2)$ (the differential pressure is the ambient hydrostatic pressure at the top of the subbase 3 less the pressure in the chambers 51 and 52 which corresponds to the hydrostatic head in the chambers 51 and 52). The sum of the hold-down forces at each corner column 15 is sufficient to prevent platform 1 lift-off under the combined effects of the buoyancy of the deballasted platform 1 and the design storm loads. The operators of the platform 1 eliminate the hold-down force when they open the chambers 51 and 52 to the ambient hydrostatic pressure and simultaneously deactivate the seals 58 (to protect the seals during liftoff).

Figure 6:
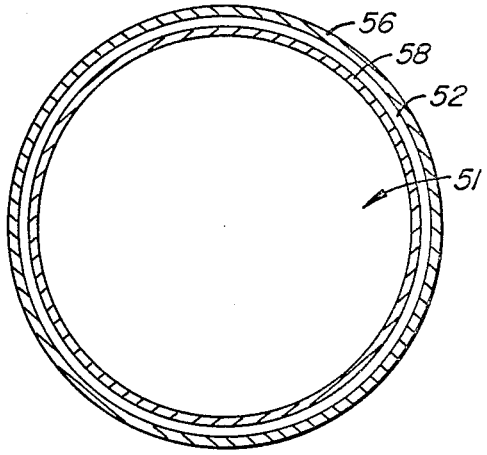
FIG. 6 is an overhead plan view of both sealing systems.

There is a space between the underside of each corner column 15 and the subbase 3, (except at a column weight bearing area 54 which carries the axial load of the platform 1). Two concentric seals 56 and 58 define this space. Elastomeric compression seals 56 are mounted on brackets 60 on the outside of the column's outer wall plates 62 (and are the outer seals), and inflatable seals 58 are mounted on the underside of the column base plates 64 concentrically spaced within the elastomeric compression seals (and are the inner seals). The inflatable seals may be set in a recessed area 66 and inflated via line 65. The space between the column 15, the subbase 3, and bounded by the inner seal 58, is referred to as the inner chamber 51, and the annular space between the two sets of seals, the column 15, and the subbase 3, as the outer chamber 52. As shown in FIG. 6, if one could look down through the column at these spaces, the outer space 52 would appear to look like a donut and the inner space 51 the hole. The bearing area 54 is not fluid-tight and therefore has no effect on the chambers 51 and 52.

Figure 5A:
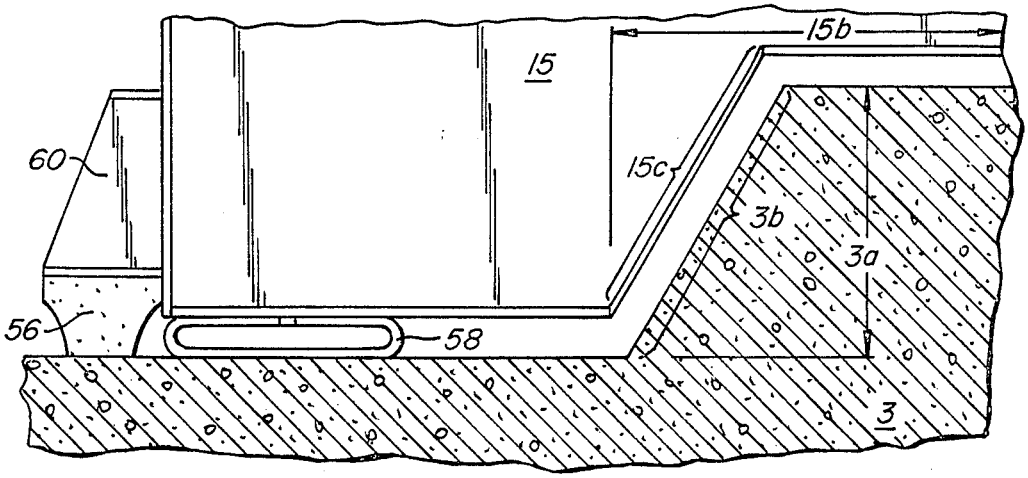
FIG. 5A is an alternate cross-sectional view of the seal system and the subbase/column interface.
Figure 15:
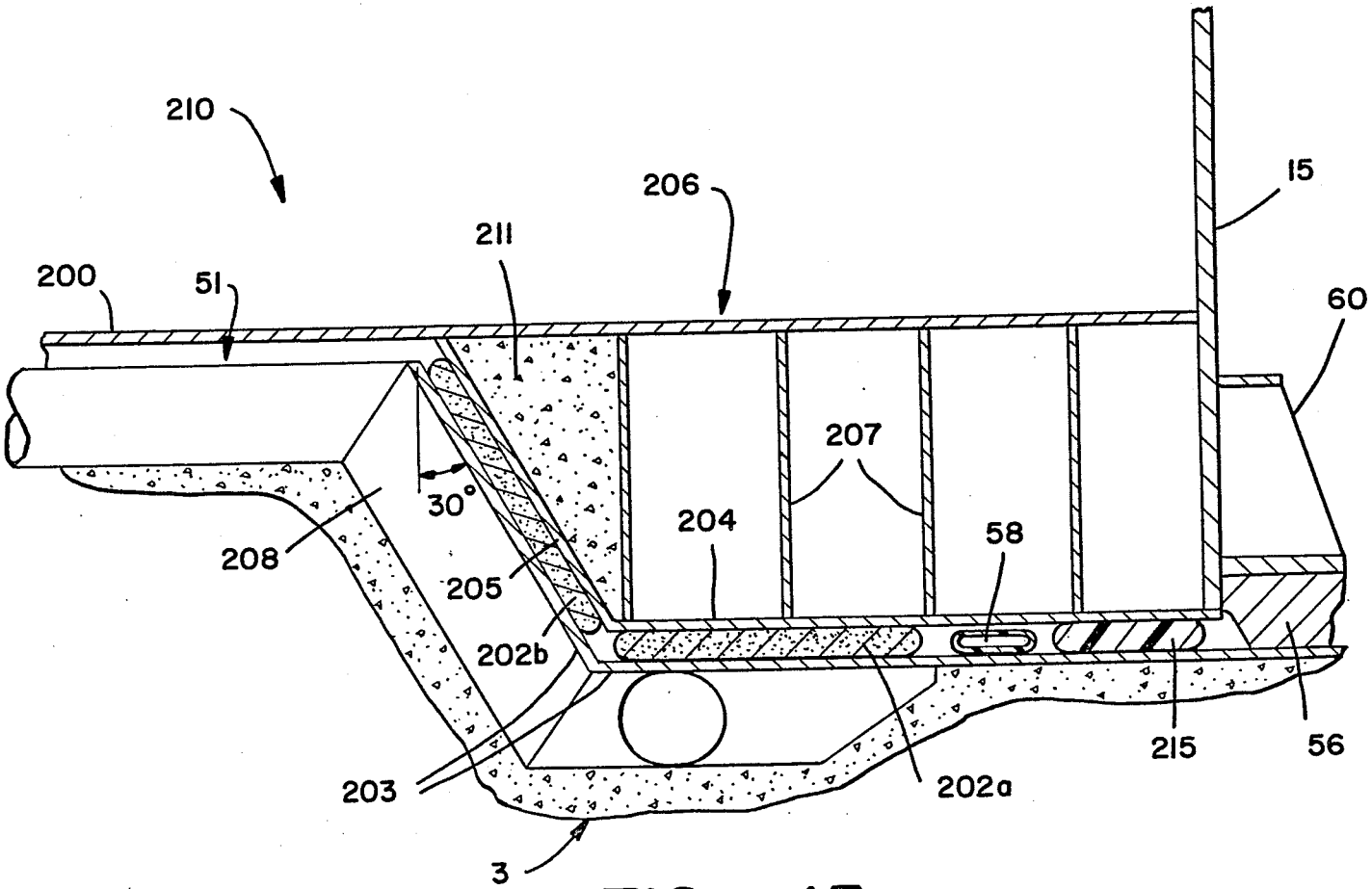
FIG. 15 is an enlarged side view of the load transfer system.

An alternate arrangement of the column 15/subbase 3 interface is shown in FIG. 5A and FIG. 15. To receive both vertical and lateral loads from the platform 1, the subbase 3 may be designed to have a raised portion **3*a* that will fit into an indented portion 15*b* in the column 15. The sides of the raised portion 3*b* and the sides of the indented portion 15*c* may be sloped and expandable grout bags may be placed between and against these sides 15*c* and 3*b*. This will compensate for construction tolerances for the platform 1 and subbase 3, and will provide a bearing surface for proper vertical/lateral load transfer between the platform 1 and subbase 3. This alternate arrangement should have little effect on the design or operation of the hold-down system 50 shown in FIG. 5**.

The outer seal 56 mounts on brackets 60 on the outside of the four corner columns 15, as shown in FIG. 5. The outer seals 56 project below the underside of the columns 15 to ensure sufficient compression and allow for the construction tolerances of the platform hull 7 and subbase 3. Virtually all vertical loads will be borne by area 54 (FIG. 5) and area **202*a*. As the platform 1 settles onto the subbase 3, the seas 56 compress by the weight of the platform 1** to create an essentially fluid-tight barrier.

Figure 7:
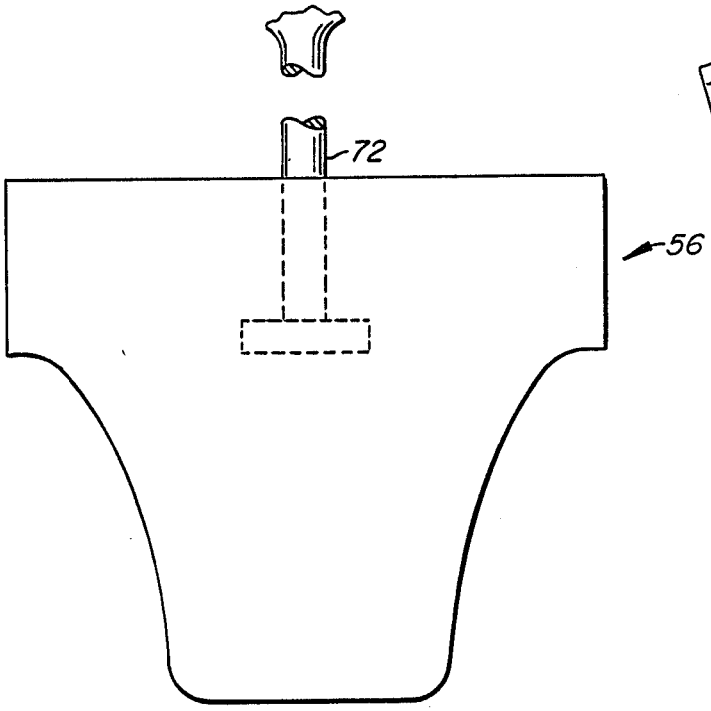
FIG. 7 is a cross-sectional view of a passive, elastomeric seal.
Figure 8:
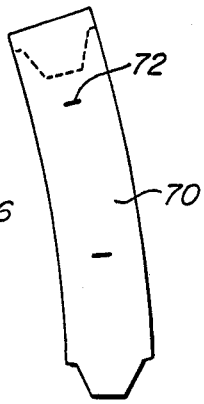
FIG. 8 is an overhead view of a segment of the passive, elastomeric seal.
Figure 9:
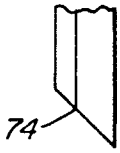
FIG. 9 is a side view of a segment of the passive, elastomeric seal.

As shown in FIGS. 7, 8, and 9, the compression seal 56 consists of 30 segments 70 (see FIG. 8) which may be made of a castable polyurethane elastomer. Bolts 72 are embedded into each segment 70 to properly mount the segment onto the support bracket 60. The segment ends 74 are mitered at 45° to produce lapped joints between segments 70.

The compression seal 56 creates a fluid-tight barrier around the outside of the column 15 with the following advantages:

No mechanical systems are required to deploy the seal, which eliminates the chance of equipment failure;

The compression seal 56 is continuously deployed when the platform 1 is resting on the subbase 3 which keeps sediment and debris from entering the hold-down chambers 51 and 52;

Although some leakage may occur after several lift-offs and reinstallations (due to a possible permanent set of the elastomer material), the total loss of the seal 56 is unlikely and leakage should be small and manageable;

The compression seal 56 requires little maintenance; and

The segments 70 may be easily replaced if damaged or excessively deformed.

The outer seals 56 would be tested on a regular basis. An operator simply reduces the pressure in the inner 51 and outer chamber 52 to subject the compression seal 56 to a differential pressure. Water in the chambers 51 and 52 can then be monitored by the operator for leakage.

When the outer seal 56 is activated by a differential pressure across the seal, it is compressed in all three directions: vertically, by the weight of the platform 1 on the subbase 3; tangentially, by hoop compression induced by the greater outside pressure; and radially, by pressing the seal against the outer wall plate 62. The bolts 72, support brackets 60, and outer wall plates 62 rigidly fix the top of the outer seal 56. Friction between the seal 56 and subbase 3 prevents the seal 56 from bending inward and upward about its fixed top.

An inflatable reinforced elastomer seal was selected for the inner seal 58. See U.S. Pat. No. 3,397,490. These inflatable seals 58 mount in chambers 66 in the underside of the four corner columns 15 just inside of the weight bearing area 54. The mounting chambers 66 are recessed so that the seals 58 do not project below the area 54 in their normal (deflated) state.

Figure 10:
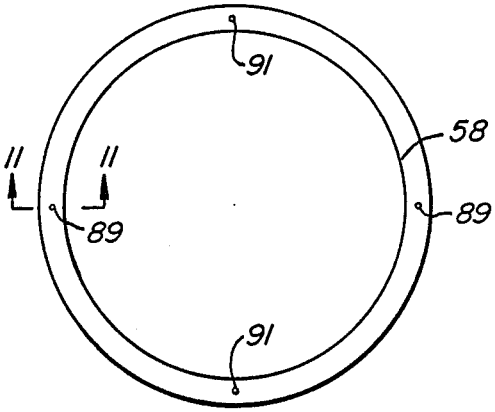
FIG. 10 is an overhead view of the arrangement of the inflatable seal.
Figure 12:
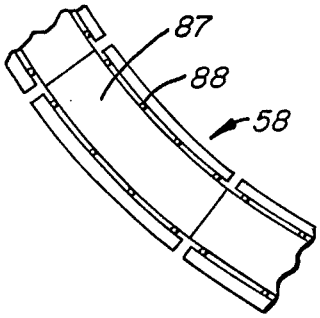
FIG. 12 is an enlarged overhead view of a section of the inflatable seal mounting plates.
Figure 11:
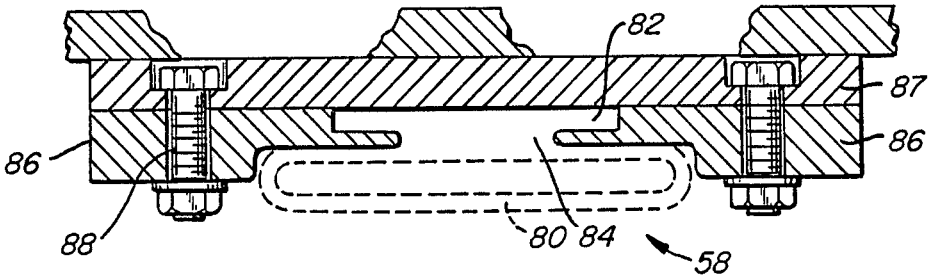
FIG. 11 is a cross-sectional view of the inflatable seal with its accompanying hardware.

The inflatable seal 58 is a single donut-shaped piece (as viewed from above in FIG. 10). It consists of a flattened tube 80, an integrally molded base 82 and a neck 84, as shown in FIG. 11. The base 82 fits into a retainer plate 86 which attaches to the underside of a seal mounting plate 87 by bolts 88 (see FIGS. 11 and 12). There are inlets 89 for pressurizing the seal 58 and outlets 91 for depressurizing the seal 58 (see FIG. 10).

The tube 80 and base 82 of the seal 58 may be molded ethylene, propylene, diene monomer (EPDM) elastomer reinforced with Kevlar (trademark of E.I. Du Pont de Nemours) fabric. This elastomer, selected for the inflatable seal 58, is a 60 durometer EPDM formulation having excellent oxidative aging resistance, and good wear and abrasion resistance. It may be reinforced by a woven fabric with two plies laminated biaxially around the tube 80, and an additional two plies incorporated along the neck area 84 where the base 82 joins the tube 80 structure.

The inflatable seal 58 was selected for the following advantages:

Inflatable seals are a proven concept and are used for a wide range of applications, such as nuclear reactor refueling cavity pool seals;

Inflatable seals conform well to uneven seating surfaces, and self-adjust within the range of vertical gaps anticipated between the undersides of the columns 15 and the top of the subbase 3;

The seals are stressed only during iceberg avoidance operations or in-service tests which prolongs their life; and Dissimilar designs and materials for the outer 56 and inner seals 58 reduce the possibility of simultaneous failure of both seals, enhancing redundancy.

The load transfer system is a passive resistance mechanism with no mechanical equipment or moving parts. The mechanism relies on bearing between horizontal and inclined surfaces to transmit vertical and lateral loads across the platform/subbase interface.

Variations in the surface contours of the column and subbase would result in at least three contact points between the two structures and very large point loads. Local failures at the contact points would be possible because of these high-point loads. By providing adjustment capabilities at the interface, these failures can be avoided; moreover, calibration can be performed to ensure that the dead load distribution between the six columns is per design.

When the platform and subbase are joined together, it is important that the two components be self-aligning. This diminishes the potential for impact to occur between portions of the structures not intended for contact.

A continuous load path allows the reaction forces, which are created at the platform/subbase interface, to be applied to the subbase, which in turn are resisted by bearing and shear reaction forces at the subbase/soil interface.

Figure 14:
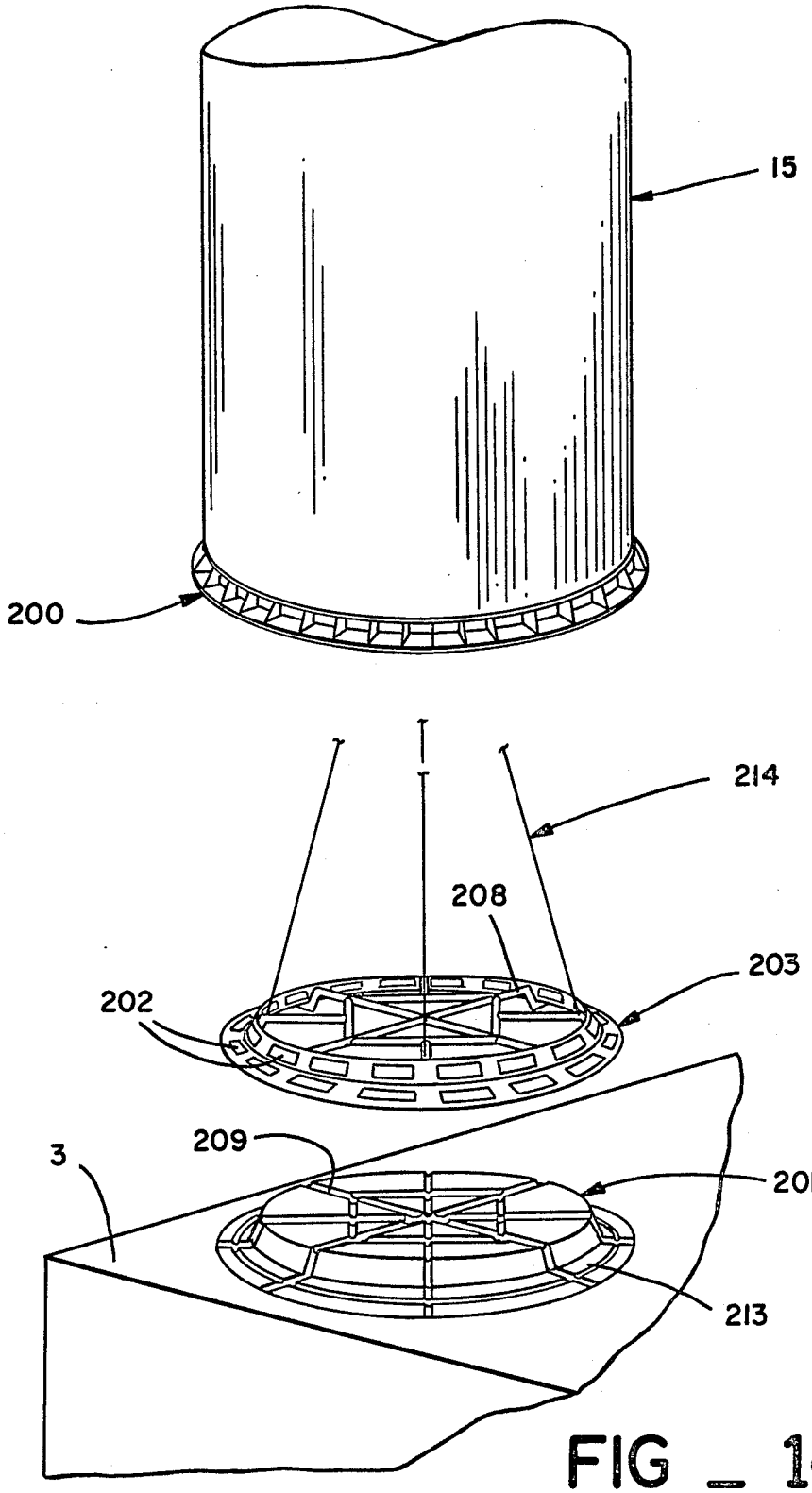
FIG. 14 is an isometric view of the load transfer system.

The load transfer system 210 is illustrated in FIGS. 14 and 15. It comprises a concave column base plate 200 fixed at the bottom of each column 15, corresponding convex concrete structural elements 201 on the subbase 3, and jacking devices 202*a* and 202*b* that are mounted on a gasket 203 and located between the column base plate and the subbase. Alignment guides may be attached to the column base plate assembly.

The column base plate 200 is comprised of a horizontal doughnut shaped bearing plate 204, an inclined truncated cone shaped bearing plate 205, and one or more horizontal circular diaphragms 206. The doughnut shaped base plate is 1½ inches thick, 5.9 ft wide, and has an outside diameter of 65.5 ft. The truncated cone shaped bearing plate is inclined at 30° from the vertical, 1½ inches thick, 3.8 ft wide, and is 53.8 ft in diameter at its base. The circular diaphragms are 1½ inches thick and 65 ft in diameter. Radial and circumferential stiffeners 207 provide additional structural integrity for the assembly.

The subbase contains a concrete upset 201 (raised section) and (optionally) a horizontal doughnut shaped bearing plate 213, 1½ inches thick, 3.9 ft wide, having an outside diameter of 67.8 ft. The upset is conical in shape with a slope of 30° from the vertical, 53 ft in diameter at its base, and 3.3 ft high. When the platform and subbase are joined, the concrete upset fits into the indented (concave) space in the column base plate 200.

The jacking devices 202*a* and *b* (Freyssinet Flatjacks in the preferred embodiment) are hydraulic capsules in the form of a flat double saucer, made of two soft grade stainless steel plates that are welded and heat-treated to produce the required internal pressure and flexibility. Inlet and outlet lines (not shown) are provided for inflation and adjustment purposes. The jacks are 3 ft wide, 8 ft long, have a 2-inch stroke (working range), and a maximum operating pressure of 2,000 psi. Epoxy resin thrust plates (not shown), 1 inch thick, are attached to both sides of the flatjack to provide the necessary bearing surfaces. Sixteen sets of flatjacks (each set consisting of horizontal flatjacks 202*a* and inclined flatjacks 202*b*) are spaced at 22.5° along the perimeter of the circular interface.

Support for the flatjacks is furnished by a radially configured, tubular steel frame 208 that fits in recesses 209 cast into the top of each subbase upset. Welded to the frame are the horizontal and inclined gaskets 203 that serve as mounting surfaces for the flatjacks. The frame also functions as a spreader bar and lifting frame for the entire assembly, as well as a pipe duct for the inlet and outlet lines required by the flatjacks.

The flatjack frames are installed on the subbase with handling slings 214 during construction and remain with the subbase after platform lift-off. Replacement of a flatjack gasket, if damaged during lift-off, would be completed prior to platform reconnection. A marine vessel with sufficient lifting capacity would be used during replacement operations.

Inflatable rubber bumpers 215 and the hard rubber bumpers (not shown), both of which serve as alignment guides, are mounted on the underside of the column base plate 200. The inflatable rubber bumpers are attached to the horizontal base plate between the inner and outer hold-down system seals, and the hard rubber bumpers are evenly spaced at 22.5° along the inclined bearing plates 205 so not to interfere with the flatjack arrangement.

The alignment guides are installed onshore during platform construction. Replacement of the bumpers, if required, would take place in the platform floating mode with diver and workboat assistance.

The principal functions of the load transfer system are alignment and support adjustment between the platform and subbase, and to provide a load path for gravity and environmental loads across the platform/subbase interface.

During initial platform/subbase mating operations and subsequent relocation operations, the installation sequence for the load transfer system is identical. As the two structures are brought together, initial impact occurs between the inflatable bumpers and the subbase. Once uniform contact is secured, the hard rubber bumpers align the platform into its final position. Ballasting operations continue until predetermined seating forces are established in the inflatable bumpers. The hold-down system is activated, thereby dewatering the hold-down chamber 51 and allowing hookup of flatjack grout and vent lines via watertight hatches in the column base plate assemblies. Ballasting is completed and the flat jacks are then inflated with hydraulic fluid and adjusted to provide dead load distribution per design. Upon completion of final adjustments, the hydraulic fluid is purged from the flatjacks and replaced with high strength cement grout. The hold-down system is deactivated and the load transfer system installation is complete.

During in-place operations, the load transfer system requires no maintenance or adjustment. Gravity and environmental loads are transmitted in bearing from the platform to the subbase via the grout-filled flatjacks. Grout or cement 211 may also be introduced into the spaces formed by stiffners 207.

During normal operations, the inflatable seal 58 internal pressure equals the hold-down chamber pressures (i.e., external seawater pressure). To fully deploy the inner seal 58 for iceberg emergency operations and in-service tests, the internal pressure of the seal 58 is first increased using seawater to an overpressure substantially greater than the external seawater pressure. An operator would then reduce the pressure in the inner chamber 51 to create the hold-down force. The inner seal 58 functions as a backup to the outer seal 56. If the outer chamber 52 is at ambient hydrostatic pressure (due to a leak in the outer seal 56 or to test the inner seal 58), the low pressure in the inner chamber and its enclosed area still provides a slightly smaller, but automatic, hold-down force.

During iceberg avoidance operations, the inflatable seal 58 would be subjected to a large differential pressure if the outer seals 56 could not maintain a pressure difference. The seal 58 is rigidly fixed at its base 82. The differential pressure load, which tends to compress the seal 58 radially and to bend the tube 80 inward and upward about the neck 84, is substantially resisted by high seal-to-subbase friction. The required friction is generated by a sufficient internal seal pressure to create large normal forces.

Figure 13:
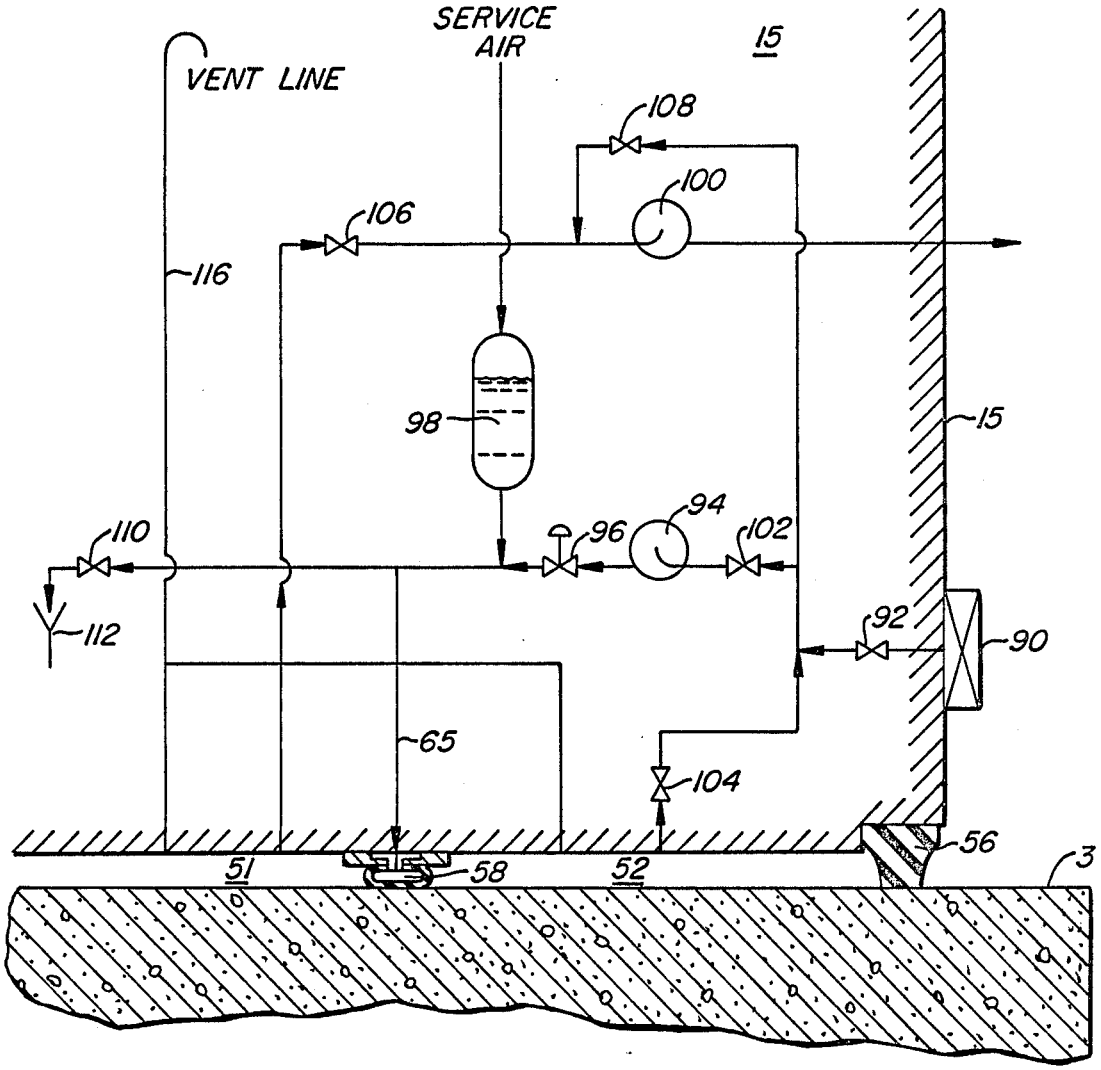
FIG. 13 is a schematic representation of the mechanical equipment inside each sealed column involved in operating the hold-down system.

To activate the inflatable sealing system 58 (see FIG. 13), seawater is pumped from a sea chest 90 to the seal 58 via a first pump 94. Valves 104, 106, and 108 are closed, while valves 92, 102, and 96 are open. Once the seal 58 is inflated to the proper pressure, the seawater is allowed to flow into, and pressurize, an inflatable seal head tank 98. When the head tank operating pressure has been attained, the valves 92 and 96 are closed. The seal head tank 98 is an accumulator tank using compressed service air, which provides a means to adjust the internal pressure on the inflatable seal 58. This tank 98 would also provide some reserve energy should the inflatable seal 58 lose differential pressure, and would allow corrective action prior to any substantial loss of sealing ability (float valves may be used to detect leaks in either of the hold-down chambers 51 and 52, and to trigger the water removal apparatus described below). When the system is activated, the seal head tank 98 pressurizes the inflatable seal 58 and valve 96 acts as a relief valve. However, in the event of an emergency, valve 110 and drain 112 are also provided to relieve the water pressure from the seal head tank 98. After the pressure is relieved, proper instrumentation may then be used to determine when the appropriate internal seal pressure has again been reached and the valve 96 may again be closed. After the inflatable seal 58 is pressurized, the inner space 51 and the outer space 52 may then be dewatered by a second pump 100. The second pump 100 may be operated to dewater the inner space 51 through valve 106, now open while valve 108 remains closed. (A sump in the top of the subbase may or may not be necessary for dewatering and if one is used, then a float valve could be placed in it to detect leaks and to dewater the space). The pump system expels the water outside the structure. At this point, continuous pumping and an atmospheric vent 116 lower and then maintain the pressure inside the inner space 51 at approximately atmospheric pressure. Valves 106 and 102 are then closed, and valve 108 opened. The second pump 100 dewaters the outer space 52 through valves 104 and 108. Again, water is expelled outside the structure. Continuous pumping and an atmospheric vent 118 lower and then maintain the pressure inside the outer space 52 at approximately atmospheric pressure. There is now a reduced hydrostatic head in the area underneath the columns 15 and since redundant seals 56 and 58 seal off this area from the surrounding seawater creating a hold-down force, the platform 1 remains affixed to the subbase 3 even during deballasting, when platform buoyancy is increased. As leaks in the chambers 51 and 52 are detected by float valves, the second pump 100 will dewater the spaces once the correct valves are opened and closed.

Operation of the hydrostatic hold-down system 50 is not necessary for the RBFS during normal operating conditions, however, the seals 56 and 58 would be frequently leak tested. Prior to platform evacuation for an iceberg emergency, the seals 56 and 58 are engaged, and the platform 1 is deballasted by pumping out the ballast chambers in the columns 15 and **15*a*, the upper horizontal braces 10 and 19, and the diagonals 11. The ballast pumps are sized to deballast the platform 1** in approximately five hours. Redundant control of ballast tanks from several independent pumps is designed into the system, and ballast control is fully automated with manual backup.

Since the RBFS can evacuate the site on impending impact of a large iceberg, all oil/gas/water piping and control lines between the platform 1 and subbase 3 must be readily disconnectible. (None of which are illustrated.) The production and injection wells and oil sales lines are first shut in subsea and all pipelines and individual fluid lines in the integrated riser bundles are purged with seawater. Before site evacuation can take place, it is necessary to hydraulically disengage the production riser mechanical latching systems and lift each of four integrated riser bundles up into the columns **15*a* by means of hydraulic hoists on the deck 5. Two electrical control bundles inside the columns 15*a* are also disconnected from the subbase 3 and retrieved. Drilling operations are halted, the wells are secured, and the drilling risers recovered onto the deck 5**. These are the final preparatory steps before platform liftoff and occur concurrently with platform deballasting.

The platform 1 may lift-off once the hydrostatic pressure that acts on the bottom of the columns 15 is restored to the ambient seawater pressure. This may be done by flooding the inner 51 and outer chambers 52. The proper procedure would be to simultaneously shut down the first 94 and second pumps 100 and open valves 92, 102, 104, 108, and 106 that connect the sea chest 90 to spaces 51 and 52 and inner seal 58. This would allow seawater to flow into the chambers 51 and 52 and reestablish hydrostatic equilibrium. The seal 58 is simultaneously deflated to prevent it from being damaged during liftoff and to speed the flooding process. Valves 110 and 96 are opened for this purpose.

Immediately after the platform 1 lifts off the subbase 3, the platform 1 moves away under positive navigational control achieved with a thruster system built into the platform 1. Eight thrusters 17 are positioned at locations above the horizontal pontoon braces 13 of the hull 7 (see FIG. 1). The thruster system can steer the platform 1 in a controlled drift manner, but cannot stationkeep in severe storm conditions. Tugs in the vicinity (for iceberg towing, surveillance and other purposes) provide further steering control once sea conditions permit attachment of towing lines.

When sea and ice conditions again permit, the platform 1 is re-sited on the subbase and the platform 1 is reballasted. Re-siting is performed with the permanent onsite mooring system, the platform's tendon relocation system and docking devices, as discussed earlier for the first method of initial RBFS installation. After final water ballasting is complete, then hold-down system 50 is fully tested. The integrated riser bundles are then stabbed into their receptacles in the subbase by hydraulic hoists on the deck 5 which can stab a riser connector down onto a connector mandrel in the subbase receptacle. Electric control bundles are reconnected. Drilling risers can also be reattached to the wellheads in the well template through a centrally located moon-pool in the deck 5 and normal drilling operations can resume.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. A load transfer system for an offshore structure mounted to a subbase comprising:

an offshore structure;

a vertical member of said offshore structure, said vertical member having a concave base plate;

a convex raised section on the subbase, the raised section generally adapted to fit into said concave base plate;

a convex frame generally adapted to fit between said convex raised section and said concave base plate; and hydraulic capsules mounted on said convex frame, said capsules adopted to be inflated whereby a load on said capsules can be adjusted.

2. Apparatus as recited in claim 1 wherein said capsules are flatjacks.

3. Apparatus as recited in claim 1 wherein said capsules are spaced along a perimeter of said frame.

4. Apparatus as recited in claim 1 further comprising means for adjusting the load on said capsules with hydraulic fluid and means for subsequently filling said capsules with grout.

5. Apparatus as recited in claim 1 wherein said convex frame is a tubular steel frame and further comprising recesses in said convex raised section, said recesses adopted to receive said frame.

6. Apparatus as recited in claim 1 further comprising resilient bumpers mounted to said concave base plate.

* * * * *